United States Patent [19]

Diel et al.

[11] Patent Number: 4,907,439

[45] Date of Patent: Mar. 13, 1990

[54] ROLL STAND WITH SYSTEM FOR AXIALLY DISPLACEABLE ROLLS

[75] Inventors: Hartmut Diel, Mönchen-Gladbach; Hans-Heinrich Hartmann, Meerbusch, both of Fed. Rep. of Germany

[73] Assignee: SMS Schloemann-Siemag Aktiengesellschaft, Dusseldorf, Fed. Rep. of Germany

[21] Appl. No.: 119,352

[22] Filed: Nov. 10, 1987

[30] Foreign Application Priority Data

Nov. 10, 1986 [DE] Fed. Rep. of Germany ..... 3638330

[51] Int. Cl.[4] ..... B21B 31/18; B21B 31/30

[52] U.S. Cl. ..... 72/247; 72/238; 72/243; 72/245

[58] Field of Search ..... 72/247, 243, 241, 238, 72/239, 245

[56] References Cited

U.S. PATENT DOCUMENTS 4,627,261 12/1986 Schiller ..... 72/247
4,736,609 4/1988 Schiller et al. ..... 72/247 X

FOREIGN PATENT DOCUMENTS 0043991 12/1979 Japan ..... 72/247
0009513 1/1982 Japan ..... 72/247
0052913 3/1986 Japan ..... 72/247
0052914 3/1986 Japan ..... 72/247

*Primary Examiner*—W. Donald Bray

*Attorney, Agent, or Firm*—Herbert Dubno; Andrew Wilford

[57] ABSTRACT

A roll stand comprises a frame, a pair of upper guide members spaced apart on the frame along an upper axis and a pair of lower guide members spaced apart on the frame along a lower axis parallel to the upper axis. Guide formations between the members and the frame prevent the members from moving axially relative to the frame and permit the members to move vertically in the frame. Respective upper and lower journal blocks on the members are prevented from moving vertically relative to the respective members by respective guide formations between the blocks and the members but can move axially on the members. An upper roller is carried between the upper journal blocks, axially coupled thereto, and rotatable thereon about the upper axis and a lower roller is carried between the lower journal blocks, axially coupled thereto, and rotatable thereon about the lower axis. A vertically effective piston-and-cylinder unit can displace the rolls and the respective journal blocks between a use position with the axes relatively far apart and a service position with the rolls relatively closely spaced. Respective upper and lower actuators each have a pair of relatively movable parts one of which is fixed to the respective guide member. Respective interengageable coupling formations on the other parts of the actuators and on the journal blocks are engageable in each other to couple each other part to the respective journal block only in the use position of the rolls.

7 Claims, 2 Drawing Sheets

ROLL STAND WITH SYSTEM FOR AXIALLY DISPLACEABLE ROLLS

FIELD OF THE INVENTION

The present invention relates to a roll stand. More particularly this invention concerns an apparatus for axially shifting the rolls of a roll stand in a rolling mill or the like.

BACKGROUND OF THE INVENTION

A roll stand of the type described in German patent document 2,440,495 has rolls that are mounted for rotation only about respective axes in journal blocks that themselves are axially displaceable in the frame of the roll stand. Respective pairs of hydraulic piston-and-cylinder units normally provided on the service side of the stand each have one part permanently fixed on the frame of the stand and another part movable relative to the one part and fastened by some removable link to a respective journal block. Expansion or contraction of the actuators of one such pair will axially shift the journal block it is connected to, the roll axially fixed in this journal block, and the drive-side journal block also axially fixed to the roll and axially slidable in the frame.

The purpose of such a construction is to allow axial opposite displacement of two like rolls, normally the working rolls and/or the inner backup rolls. Such axially opposite shifting of these rolls has, as is well known in the art and described at length in other patents of this same assignee, an effect on workpiece shape and roll wear.

In the known systems force is transmitted to each journal block from the respective pair of hydraulic actuators by links connected to generally radially or tangentially extending arms formed on the respective journal block, the rolls being as is normal axially fixed albeit rotatable in the respective journal blocks. Since part of each actuator is mounted on the frame on the service side of the stand next to the respective journal block, which itself is vertically displaceable in the stand to adjust nip height or workpiece thickness, it is necessary that the link connecting the actuators to these arms permit some relative vertical movement perpendicular to the normally horizontal axis of the actuator which itself is parallel to the roll axes.

The standard procedure as described in German patent document 3,331,055 is to provide these arms each with a vertically extending pusher rail which is flanked front and back with some play by rails of the link. The outer link-mounted rail, that is the one further from the frame, must be removable so that the respective roll and its journal blocks can be pulled axially out of the stand for regrinding or replacement. When the cylinder is the frame-mounted part of the actuator, this cylinder is formed on its flat vertical side turned toward the respective journal block with a groove extending parallel to the roll axis and receiving a guide rail of the respective journal block. For removal of the roll this guide rail must also be made dissassemblable.

OBJECTS OF THE INVENTION

It is therefore an object of the present invention to provide an improved roll-shifting apparatus for a roll stand.

Another object is the provision of such a roll-shifting apparatus for a roll stand which overcomes the above-given disadvantages, that is which ensures solid coupling of each actuator to the respective journal block, but that also permits removal of the respective roll without having to perform any extra steps to uncouple the actuators.

SUMMARY OF THE INVENTION

A roll stand comprises a frame, a pair of upper guide members spaced apart on the frame along an upper axis, and a pair of lower guide members spaced apart on the frame along a lower axis parallel to the upper axis. Guide formations between the members and the frame prevent the members from moving axially relative to the frame and permit the members to move vertically in the frame. Respective upper and lower journal blocks on the members are prevented from moving vertically relative to the respective members by respective guide formations between the blocks and the members but can move axially on the members. An upper roller is carried between the upper journal blocks, axially coupled thereto, and rotatable thereon about the upper axis and a lower roller is carried between the lower journal blocks, axially coupled thereto, and rotatable thereon about the lower axis. A vertically effective piston-and-cylinder unit can displace the rolls and the respective journal blocks between a use position with the axes relatively far apart and a service position with the rolls relatively closely spaced.

Respective upper and lower actuators each have a pair of relatively movable parts one of which is fixed to the respective guide member. Respective interengageable coupling formations on the other parts of the actuators and on the journal blocks are engageable in each other to couple each other part to the respective journal block only in the use position of the rolls. Thus in the service position the rolls can be moved axially independently of the actuators.

This system eliminates the need for the vertically extending coupling formations securing the journal blocks to the actuators, since the actuators travel vertically with the journal blocks. It also makes it possible to couple the journal blocks to the respective actuators merely by vertically moving them.

According to this invention the vertically effective piston-and-cylinder unit is braced between the guide members and includes respective vertically extensible double-acting hydraulic cylinders having piston and cylinder parts one of which is fixed in the respective upper guide member the other of which is fixed in the respective lower guide member. The cylinder parts can be formed in the lower guide members and have pressurizable front and back compartments vertically flanking the piston part. This is distinguished from the prior-art bending units which typically are only single-acting, not double-acting a here.

Each actuator according to the present invention includes a piston fixed on the respective guide member and a respective cylinder couplable via the coupling formations to the respective journal block. In addition the coupling formations include downwardly and upwardly projecting flanges on the upper and lower journal blocks and upwardly and downwardly open grooves for the respective flanges on the respective lower and upper journal blocks.

DESCRIPTION OF THE DRAWING

The above and other objects, features, and advantages will become more apparent from the following, reference being made to the accompanying drawing in which.

SPECIFIC DESCRIPTION

Figure 1:
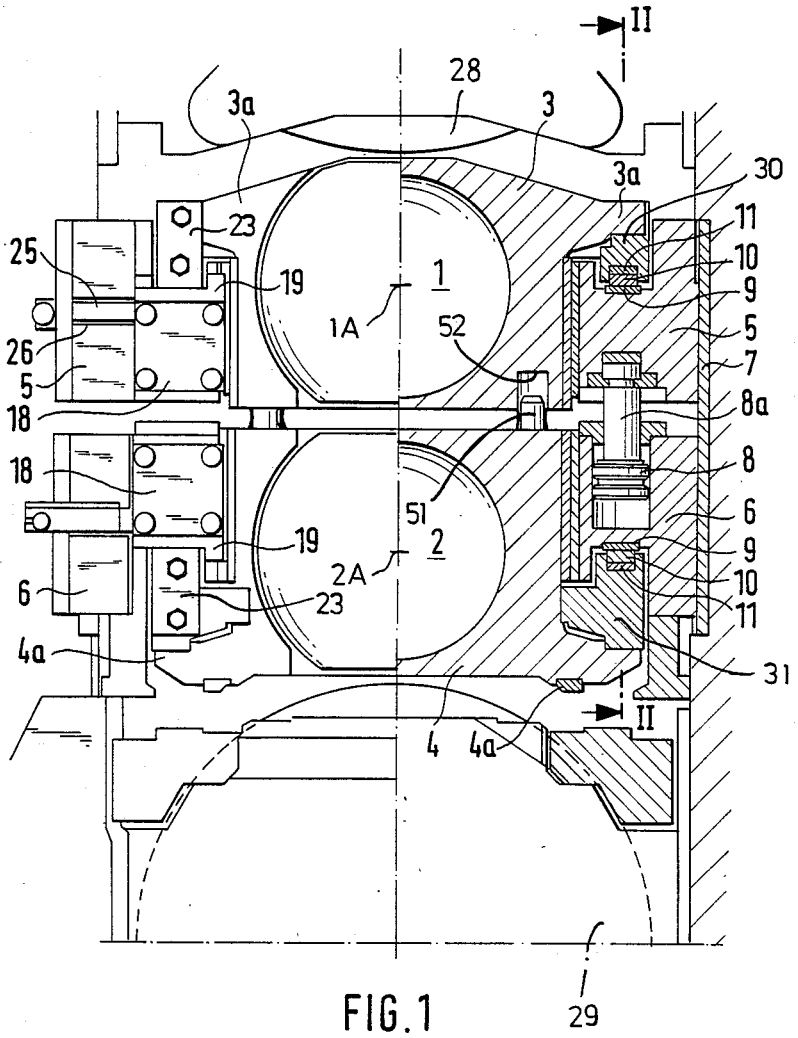
FIG. 1 is a view of the service side of the roll stand according to the instant invention, in elevational side view on the left and in section on the right.
Figure 2:
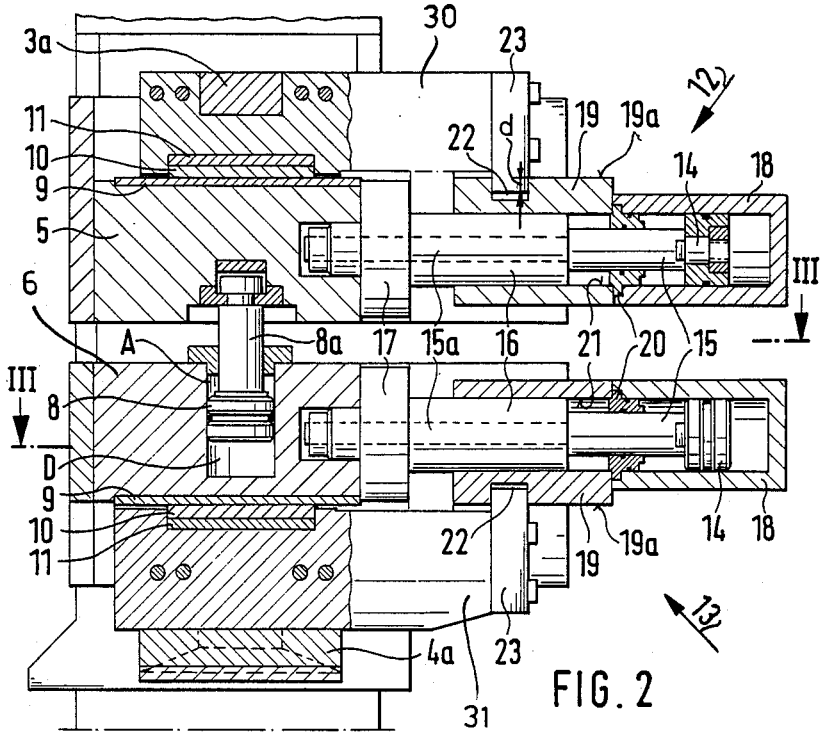
FIG. 2 is a vertical section taken along line II—II of FIG. 1.
Figure 3:
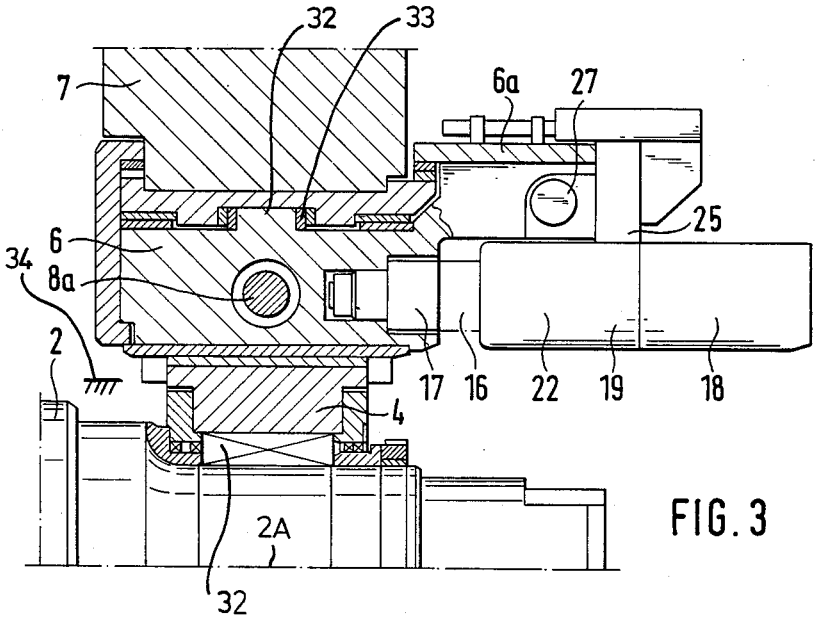
FIG. 3 is a horizontal section taken along line III—III of FIG. 2.

As seen in FIGS. 1, 2, and 3 the four-high roll stand according to this invention has a frame 7 carrying two working rolls 1 and 2 rotatable about parallel horizontal axes 1A and 2A and engaging respective backup rolls 28 and 29 The rolls 1 and 2 are rotatable but axially fixed by their bearings 32 (FIG. 3) in respective pairs of axially spaced upper and lower journal blocks 3 and 4 each having a pair of lateral extensions 3*a* and 4*a*. The journal blocks 3 and 4 are axially displaceable in respective pairs of guide members 5 and 6 which themselves are vertically displaceable in the frame 7 of the stand, but axially nondisplaceable therein. Interfitting vertical ridges 34 on the members 5 and 6 (see FIG. 3) and grooves 33 on the frame 7 ensure easy sliding of these members 5 and 6 in the frame 7, but effectively inhibit relative axial movement. Thus axial movement of the rolls 1 and 2 necessitates relative axial displacement of the blocks 3 and 4 and the guide members 5 and 6 while vertical displacement of the rolls 1 and 2 necessitates relative vertical displacement of the members 5 and 6 and the frame 7.

A double-acting piston 8 in each lower guide member 6 has a piston rod 8*a* fixed in the respective upper member 5 and can be pressurized front or back to appropriately bend the rolls 1 and 2 as is known. The spreading-bending force created by the piston 8 is transmitted to the guide members 5 and 6 by rails 9 and 10 and an elastic strip 11 permitting some canting of these parts relative to one another. These rails and strips 9, 10, and 11 also constitute the formations or means that permit the journal blocks 3 and 4 to move axially relative to the guide members 5 and 6 when the latter are actuated by the pistons 8 and the approach of the journal block is limited to the partial engagement of the pins 51 in the holes 50.

According to the present invention the upper and lower journal blocks 3 and 4 are each shifted relative to the respective guide members 5 and 6 by respective pairs of upper and lower hydraulic actuators 12 and 13 which are essentially identical to one another. The axially nondisplaceable or so-called fixed element of each such actuator 12 is a double-acting piston 14 having a piston rod 15 with a reduced-diameter portion 15*a* carrying a guide cylinder 16 and secured by a plate or flange 17 to the respective guide member 5 or 6. The axially movable part of each actuator 12 is formed by an outer cylinder part 18 which together with a partition seal 20 forms two opposite compartments flanking the respective piston 14 and a square-section inner part 19 formed with an offcenter cylindrical bore 21 snugly fitting on the guide cylinder 16 which, therefore, can reciprocate therein. The two parts 18 and 19 are bolted or welded solidly together.

The outer part 18 is of rounded-corner square section and the inner part 19 is of vertically elongated rectangular section with three of its sides coplanar with the corresponding vertical and bottom faces of the outer part 18. The fourth side 19*a* of the inner part 19 extends past the corresponding upper face of the cylinder part 18 and is formed with an upwardly open notch 22. The respective extension 3*a* or 4*a* carries a rail 30 or 31 that also carries the respective strip 11, which extends axially and that has a vertically depending end flange 23 that fits snugly, that is without play, in the notch 22. Thus the cylinder parts 18 and 19 are axially arrested relative to the respective journal blocks 3 and 4 by the interfit of the respective entrainment formation 23 in the groove 22 and the piston parts 14, 15, and 16 are fixed by the plate 17 to the respective guide members 5 and 6. The cylinder part 18 is guided on the piston 14 and the part 19 on the guide sleeve 16 at some axial spacing so that the hydraulic actuators 12 and 13 will remain parallel to each other. In addition the surfaces 19*a* virtually ride on the confronting faces of the rail 30 or 31 so that canting of these actuators 12 and 13 is impossible.

This structure has the considerable advantage that the hydraulic actuators travel vertically with the respective working rolls 1 and 2. This arrangement is substantially simpler and more efficient than the prior-art system of mounting the fixed actuator part on the frame and providing a link permitting relative movement between the movable part and the journal block. Furthermore, it spares the formations 31 and 32 that axially secure the guide members 5 and 6 to the frame 7 from having to transmit the force of the actuators 12 and 13.

In addition to the square interfit of the cylinder parts 18 and 19 with the respective journal blocks 2 and 3 that prevents canting of the actuators 12 and 13 about their respective axes, each inner part 19 is closely juxtaposed with an extension such as the extension shown at 6*a* of the guide member 6. As shown in FIG. 1 on the left and in FIG. 3 each inner part 19 has a horizontal bar 25 which fits in a horizontal groove 26 of the respective guide member 5 or 6. This further couples each actuator 12 or 13 to the respective guide member 5 or 6 and journal block 3 or 4 for joint vertical movement therewith.

Further according to the invention each entrainment flange 23 projects into the respective groove 22 a relatively short distance d, and the double-acting actuator piston 8 can relatively move the two rolls 1 and 2 and the respective journal blocks 3 and 4 through a vertical distance equal to more than 2*d*. Thus, whereas the chamber D of the piston 8 is pressurized for bending purposes, the chamber A, which is normally not present or pressurizable in prior-art systems, is pressurized to draw the two rolls 1 and 2 and the respective journal blocks 3 and 4 together. The frame 7 is provided with an abutment shown schematically at 33 in FIG. 3 that engages the blocks 5 and defines a middle position for the rolls 1 and 2 when they are pulled all the way together. In this position the entrainment flanges 23 are clear of the respective grooves 22 so that the rollers 1 and 2 with their respective journal blocks 3 and 4 can be pulled out of the frame 7. Normally the chamber D is merely depressurized to allow the upper roll 1 to drop all the way down atop the roll 2, but with the system of this invention the pressurization of the chamber A also pulls the rolls 1 and 2 together, but simultaneously decouples both actuators 12 from the upper journal block 3 and both actuators 13 from the lower block 4. In effect then the piston 8 serves then mainly for engaging the formations 22 and 23 together and disengaging them.

Any other bending function of such a piston is not critical to this invention.

The instant invention could also be applied to inner or outer backup rolls when same are to be shifted axially, whether jointly in the same direction or in opposite directions. Each guide member would need its own actuator which is braced on the frame.

We claim:

1. A roll stand comprising:

a frame;

a pair of upper guide members spaced apart on the frame along an upper axis and a pair of lower guide members spaced apart on the frame along a lower axis parallel to the upper axis;

guide formations between the members and the frame preventing the members from moving axially relative to the frame and permitting the members to move vertically in the frame;

respective upper and lower journal blocks on the members;

respective guide formations between the blocks and the respective members preventing the blocks from moving vertically relative to the members and permitting the blocks to move axially on the members;

an upper roller carried between the upper journal blocks, axially coupled thereto, and rotatable thereon about the upper axis;

a lower roller carried between the lower journal blocks, axially coupled thereto, and rotatable thereon about the lower axis;

means braced between the guide members for relatively displacing the rolls and the respective journal blocks generally perpendicular to the axes between a use position with the axes relatively far apart and a service position with the rolls relatively closely spaced;

respective extensible and shortenable upper and lower hydraulic ram actuators each having a piston fixed to the respective guide member and a cylinder axially slidable on the piston: and respective interengageable coupling formations on the cylinders of the actuators and on the journal blocks including downwardly and upwardly projecting and open flanges and grooves engageable in each other to couple each cylinder to the respective journal block only in the use position of the rolls, whereby in the service position the flanges are out of the respective grooves and the rolls can be moved axially independently of the actuators and in the use position the actuators can axially displace the rolls via the respective members and blocks relative to the frame.

2. The roll stand defined in claim 1 wherein the means for displacing includes respective vertically extensible double-acting hydraulic cylinders having piston and cylinder parts one of which is fixed in the respective upper guide member the other of which is fixed in the respective lower guide member.

3. The roll stand defined in claim 2 wherein the cylinder parts are formed in the lower guide members and have pressurizable front and back compartments vertically flanking the piston part.

4. The roll stand defined in claim 1 wherein the flanges are on the upper and lower journal blocks and the grooves are on the cylinders of the respective lower and upper actuators.

5. The roll stand defined in claim 4, further comprising stop means on the frame defining for the upper roller a lowermost position with its coupling formations disengaged from those of its actuators.

6. The roll stand defined in claim 4 wherein the rolls move vertically relative to one another between the positions through a predetermined stroke and the formations interengage by distances equal to at most half of this stroke.

7. The roll stand defined in claim 4 wherein each piston has an outer end relatively axially remote from the respective roll and an inner end portion spaced axially therefrom and forming an internal guide for the respective cylinder.

* * * * *